US009818498B2

(12) United States Patent
Park et al.

(10) Patent No.: US 9,818,498 B2
(45) Date of Patent: Nov. 14, 2017

(54) PASTE COMPOSITION FOR PRINTING AND TOUCH PANEL

(71) Applicant: LG INNOTEK CO., LTD., Seoul (KR)

(72) Inventors: Bong Jun Park, Seoul (KR); Sun Hong Yoon, Seoul (KR); Yong Jin Lee, Seoul (KR); Kwang Yong Jin, Seoul (KR); Kyoung Hoon Chai, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 0 days.

(21) Appl. No.: 14/354,444

(22) PCT Filed: Oct. 23, 2012

(86) PCT No.: PCT/KR2012/008716
§ 371 (c)(1),
(2) Date: Apr. 25, 2014

(87) PCT Pub. No.: WO2013/062285
PCT Pub. Date: May 2, 2013

(65) Prior Publication Data

US 2014/0264188 A1 Sep. 18, 2014

(30) Foreign Application Priority Data

Oct. 25, 2011 (KR) ..... 10-2011-0109150

(51) Int. Cl.
*H01B 1/22* (2006.01)
*H01B 1/24* (2006.01)

(52) U.S. Cl.
CPC ..... *H01B 1/22* (2013.01); *H01B 1/24* (2013.01)

(58) Field of Classification Search
CPC ..... H01B 1/22; H01B 1/24
(Continued)

(56) References Cited

U.S. PATENT DOCUMENTS 4,350,535 A 9/1982 Ishijima et al.
6,030,553 A 2/2000 Huang et al.
(Continued)

FOREIGN PATENT DOCUMENTS

CN 1244492 C 3/2006
CN 101613524 A 12/2009
(Continued)

OTHER PUBLICATIONS

International Search Report in International Application No. PCT/KR2012/008716, filed Oct. 23, 2012.
(Continued)

*Primary Examiner* — Harold Pyon
*Assistant Examiner* — Danny N Kang
(74) *Attorney, Agent, or Firm* — Saliwanchik, Lloyd & Eisenschenk

(57) ABSTRACT

Disclosed is a paste composition for printing including conductive powders, a binder, a dispersing agent, and a solvent. The dispersing agent includes a block copolymer of polyethylene oxide (PEO)-polypropylene oxide (PPO)-polyethylene oxide (PEO), or a block copolymer of polypropylene oxide (PPO)-polyethylene oxide (PEO)-polypropylene oxide (PPO).

3 Claims, 2 Drawing Sheets

(58) Field of Classification Search
USPC ..... 252/511, 514, 513, 500, 512
See application file for complete search history.

(56) References Cited

U.S. PATENT DOCUMENTS

| | | | | |
|---|---|---|---|---|
| 8,298,676 | B2 | 10/2012 | Kato et al. | |
| 2007/0199477 | A1 | 8/2007 | Hill et al. | |
| 2008/0261049 | A1* | 10/2008 | Hayashi et al. | 428/418 |
| 2010/0075139 | A1* | 3/2010 | Kato | C08J 7/042 428/336 |
| 2010/0208429 | A1* | 8/2010 | Zhang | C04B 20/1022 361/704 |
| 2011/0048277 | A1* | 3/2011 | Sivarajan et al. | 106/31.13 |
| 2011/0186121 | A1 | 8/2011 | Horteis et al. | |

FOREIGN PATENT DOCUMENTS

| | | | |
|---|---|---|---|
| CN | 101617001 | A | 12/2009 |
| CN | 101617007 | A | 12/2009 |
| CN | 101815772 | A | 8/2010 |
| JP | 2010-080237 | A | 4/2010 |
| KR | 10-2009-0030294 | A | 3/2009 |
| TW | 2011-22064 | A | 7/2011 |
| WO | WO-2008-111757 | A1 | 9/2008 |
| WO | WO 2008111757 | A1 * | 9/2008 |

OTHER PUBLICATIONS

Office Action dated Apr. 20, 2015, in Taiwanese Application No. 101139526, filed Oct. 25, 2012.
Office Action dated Nov. 30, 2015, in Chinese Application No. 201280052865.1.
Office Action dated Jul. 5, 2017 in Korean Application No. 10-2011-0109150.

* cited by examiner

[Fig. 1]
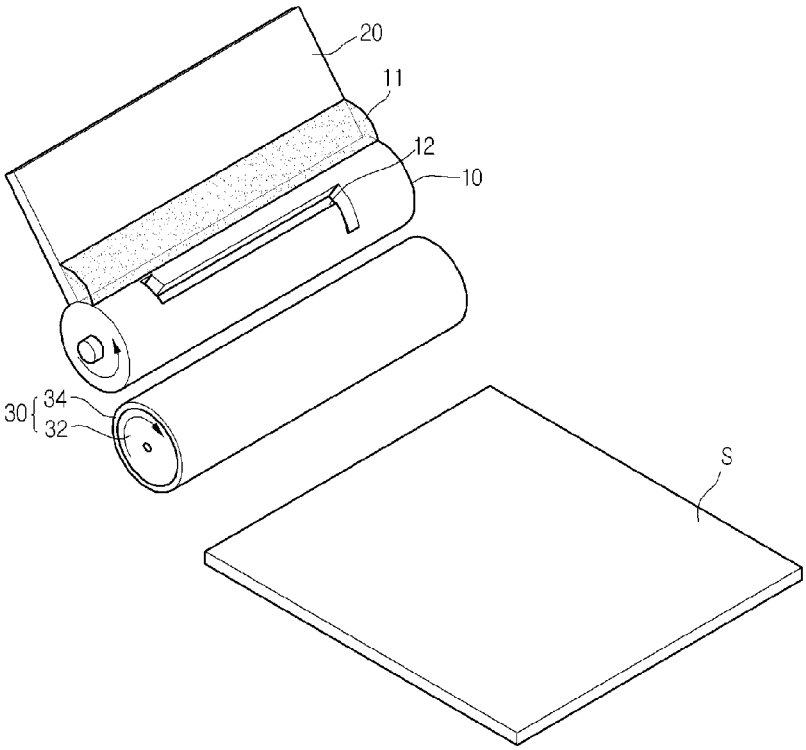
[Fig. 2]
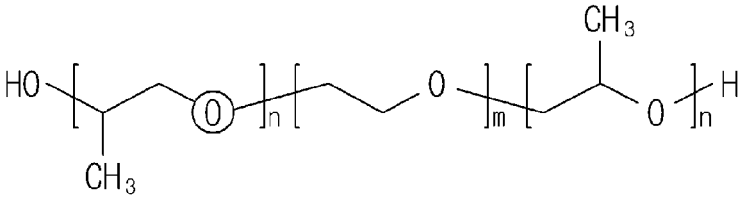
(a)
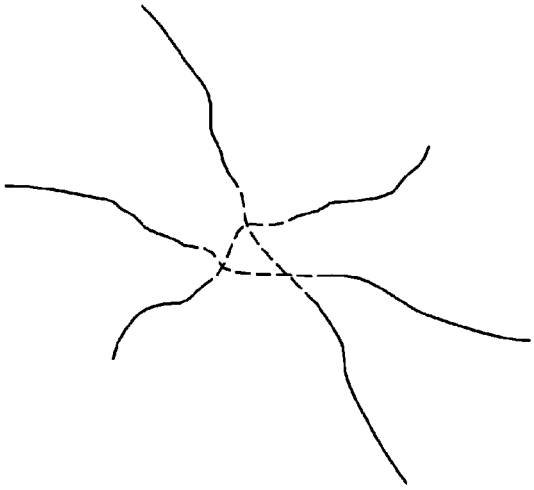
(b)

[Fig. 3]
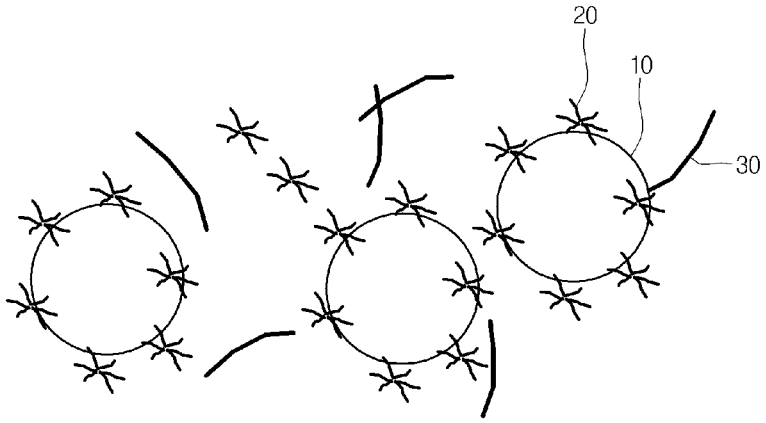

PASTE COMPOSITION FOR PRINTING AND TOUCH PANEL

CROSS-REFERENCE TO RELATED APPLICATIONS

This application is the U.S. national stage application of International Patent Application No. PCT/KR2012/008716, filed Oct. 23, 2012, which claims priority to Korean Application No. 10-2011-0109150, filed Oct. 25, 2011, the disclosures of each of which are incorporated herein by reference in their entirety.

TECHNICAL FIELD

The disclosure relates to a paste composition for printing and a touch panel including a wiring electrode prepared by using the same.

BACKGROUND ART

Recently, as various portable electronic devices such as mobile phones, PDAs, and laptop computers have been developed, the requirement for light, slight, and small flat panel displays applicable to the portable electronic devices is gradually increased. In this regard, the flat panel displays such as liquid crystal displays (LCDs), plasma display panels (PDPs), field emission displays (FEDs), and vacuum fluorescent displays (VFDs) have been actually studied and commercialized recently.

Metallic wiring patterns provided inside the devices or color filter patterns in the LCD have been realized through various schemes of forming patterns, such as a screen printing scheme and a photolithography scheme. However, according to the screen printing scheme, the patterns are formed with low precision. According to the photolithography scheme, processes are complicated in that the photoresist must be laminated, exposed, and developed. Accordingly, the schemes have the limitation in forming micro-patterns.

In other words, the wiring electrode of the touch panel according to the related art is generally formed through the photolithography scheme. The photolithography is a kind of photo process including a coating process of a photoresist, a mask alignment process, an exposure process, a developing process, and a stripping process. The photolithography takes the long process time, wastes a great amount of strip solution to remove photoresist and a photoresist pattern, and requires high-price equipment such as exposure equipment.

In particular, the photolithography has disadvantages in that the price of the exposure equipment is increased, and the control of the pitch precision and an electrode width is difficult as the size of a substrate is enlarged and a pattern size is reduced.

Accordingly, as the substitute for the photolithography, a gravure offset printing scheme employing a blanket for printing has been developed. Since the gravure offset printing scheme may make a line pattern thin, the gravure offset printing scheme has been spotlighted as the substitute for the photolithography.

The gravure offset printing scheme is a printing scheme used in forming the electrodes of the flat panel displays by using an intaglio scheme and/or a relief scheme and the transfer characteristic of ink. In general, the offset printing scheme is classified into two processes of an off process and a set process. Before the off process is performed, a paste composition is filled in a printing roll having a pattern with micro-line width and depth, and then a doctoring process to strip off composition flowed over the printing roll is performed. Thereafter, according to the off process, a blanket roll and the printing roll filled with the composition are continuously pressurized with respect to each other while rotating, so that the composition filled in the groove of the printing roll is transferred to a silicon-rubber surface of the blanket roll. In addition, according to the set process, the blanket having a silicon-rubber surface and a glass plate are pressurized with respect to each other while rotating, so that the composition transferred onto the silicon surface of the blanket is transferred onto the glass plate again.

In order to print a micro-pattern through the offset printing scheme, the paste must be sufficiently filled in the gravure pattern, and must be neatly transferred to the blanket due to the superior matching with the blanket.

In particular, in order to print a micro-pattern of 50 μm or less, the paste must include metallic micro-particles of 5 μm or less, and must be excellently dispersed. However, the acryl-based dispersing agents according to the related art represent the lower solubility with respect to an ether solvent and thus cause the problems related to the adhesive strength.

In order to solve the above problems, a paste composition for printing capable of facilitating an inking work by improving particle dispersibility is required.

DISCLOSURE OF INVENTION

Technical Problem

The embodiment provides a paste composition for printing, capable of improving particle dispersibility with a dispersing agent including a block copolymer of PEO-PPO-PEO or a block copolymer of PPO-PEO-PPO added to the paste composition for printing, and a touch panel including a wiring electrode using the paste composition.

Solution to Problem

According to the embodiment, there is provided a paste composition for printing including conductive powders, a binder, a dispersing agent, and a solvent. The dispersing agent includes a block copolymer of polyethylene oxide (PEO)-polypropylene oxide (PPO)-polyethylene oxide (PEO), or a block copolymer of polypropylene oxide (PPO)-polyethylene oxide (PEO)-polypropylene oxide (PPO).

Advantageous Effects of Invention

As described above, the paste composition for printing according to the embodiment includes the dispersing agent including the block copolymer of the PEO-PPO-PEO or the block copolymer of the PPO-PEO-PPO.

Therefore, in the paste composition for printing according to the embodiment, the dispersibility of the functional particles dispersed in the ether solvent can be improved.

In addition, differently from acrylic dispersing agents according to the related art, the paste composition for the printing according to the embodiment is not subject to the oxidation reaction with silver (Ag) powders, thereby preventing the metallic conductive powders from being oxidized.

Therefore, the inking work can be facilitated by improving particle dispersibility using the paste composition for printing. In addition, the micro-wiring electrode can be neatly patterned by using the paste composition.

BRIEF DESCRIPTION OF DRAWINGS

FIG. 1 is a view showing a printing apparatus employing a paste composition for printing according to the embodiment;

FIG. 2 is a schematic view showing the chain of a block copolymer of polypropylene oxide (PPO)-poly (ethylene oxide) (PEO)-polypropylene oxide (PPO) according to the embodiment; and FIG. 3 is a view showing the dispersion of particles in the paste composition for printing according to the embodiment.

MODE FOR THE INVENTION

In the description of the embodiments, it will be understood that when a substrate, a layer, a film or an electrode is referred to as being "on" or "under" another substrate, another layer, another film or another electrode, it can be "directly" or "indirectly" on the other substrate, the other layer, the other film, or the other electrode, or one or more intervening layers may also be present. Such a position of the layer has been described with reference to the drawings.

Hereinafter, a paste composition for printing and a wiring electrode formed by using the paste composition for printing according to the present invention will be described in detail.

FIG. 1 is a view showing a printing apparatus employing a paste composition for printing according to the embodiment.

Referring to FIG. 1, the printing apparatus includes a gravure roll 10, a doctor blade 20, and a blanket roll 30.

The gravure roll 10 includes a pattern groove 12 having a predetermined depth. For example, the gravure roll 10 may have a cylindrical shape so that the gravure roll 10 may be rotatably installed. The gravure roll 10 may include various materials capable of conserving a paste 11 filled in the pattern groove 12 while preventing the gravure roll 10 from being damaged due to the repeated printing processes. For example, the gravure roll 10 may include metal.

The doctor blade 20 is positioned in the contact with the gravure roll 10 so that the paste 11 is filled in the pattern groove 12.

Although not shown in drawings, the doctor blade 20 may include a doctor part and a fixing part. Alternatively, the doctor blade 20 may further include other parts if necessary.

The blanket roll 30 may include a base roll 32 and a blanket 34.

For example, the base roll 32 has a cylindrical shape so that the base roll 32 may be rotatably installed. The base roll 32 may include stainless steel.

The blanket 34 may be wound around an outer circumferential surface of the base roll 32. The blanket 34 may include rubber. The blanket 34 provides a predetermined pattern to a substrate S as the base roll 32 rotates.

The paste composition for printing according to the embodiment may be filled in the pattern groove 12.

The paste composition for printing according to the embodiment may include conductive powders, a binder, a dispersing agent, and a solvent. The paste composition for printing may include a block copolymer of poly (ethylene oxide) (PEO)-polypropylene oxide (PPO)-poly (ethylene oxide) (PEO), or a block copolymer of polypropylene oxide (PPO)-poly (ethylene oxide) (PEO)-polypropylene oxide (PPO).

In addition, the paste composition for printing may further include a curing agent.

The conductive material may include at least one selected from the group consisting of silver (Ag), gold (Au), platinum (Pt), copper (Cu), palladium (Pd), aluminum (Al), nickel (Ni), graphite, and carbon-nano tubes (CNT), or the alloy thereof, but the embodiment is not limited thereto. Preferably, the conductive material may include silver (Ag) powders.

The conductive powders may include contents of about 50 weight % to about 90 weight % with respect to the paste composition for the printing. If the content of the conductive material is less than about 50 weight %, the conductivity of an electrode may not be sufficiently ensured. If the content of the conductive material exceeds about 90 weight %, a transfer may not be sufficiently performed upon offset printing, and the thickness of the electrode may be excessively thickened.

The dispersion agent may include the block copolymer of PEO-PPO-PEO, or the block copolymer of PPO-PEO-PPO.

The block copolymer of PEO-PPO-PEO, or the block copolymer of PPO-PEO-PPO may include the contents of about 0.001 weight % to about 2 weight % with respect to the paste composition for the printing. Preferably, the block copolymer of PEO-PPO-PEO, or the block copolymer of PPO-PEO-PPO may have the contents of about 0.001 weight % to about 2 weight %.

Even if the dispersing agent is added with the contents of at least about 2 weight %, the particle dispersibility effect may be lowered. If the dispersing agent is added with the contents of less than about 0.001 weight %, the particle dispersibility effect is slightly represented, so that the dispersibility of metallic nano-particles may be degraded.

The block copolymer of PEO-PPO-PEO, or the block copolymer of PPO-PEO-PPO has higher solubility with respect to an ether solvent used in the paste composition for printing. In addition, the block copolymer of PEO-PPO-PEO, or the block copolymer of PPO-PEO-PPO represents lower reactivity with the metallic conductive powders, thereby preventing the conductive powders from being oxidizing.

According to the related art, dispersing agents having acrylic material or carboxyl-functional group have been used. However, the dispersing agents having the acrylic material or the carboxyl-functional group represent lower solubility with respect to ether solvent, and problems related to the adhesive strength may be caused. In addition, the acrylic dispersing agent represents higher reactivity with respect to metallic conductive powders so that the acrylic dispersing agent causes the oxidation of the metallic conductive powders.

In contract, the dispersing agent including the block copolymer of PEO-PPO-PEO, or the block copolymer of PPO-PEO-PPO according to the embodiment represents higher solubility with respect to the ether solvent so that the dispersing agent can improve the dispersing characteristic of functional particles dispersed in the ether solvent. The dispersing agent represents lower reactivity with the metallic conductive powders, thereby preventing the conductive powders from being oxidizing.

The solvent may include organic solvent that may dissolve the binder. The organic solvent may include the contents of about 5 weight % to about 15 weight % with respect to the paste composition for printing.

The solvent may include one selected from the group consisting of alcohols, glycols, polyols, ethers, glycol ethers, ether esters, and esters, but the embodiment is not limited thereto.

The binder may provide the adhesive strength between the conductive powders and the substrate. The binder may include the contents of about 3 weight % to about 10 weight % with respect to the paste composition for printing.

The binder may include one selected from the group consisting of epoxy, ester, acryl, and vinyl, but the embodiment is not limited thereto.

In other words, the paste composition for printing according to the embodiment may include the dispersing agent having the contents of about 0.001 weight % to about 0.5 weight % with respect to the whole contents of the paste composition for printing, the conductive powders having the contents of about 50 weight % to about 90 weight % with respect to the whole contents of the paste composition for the printing, and the binder having the contents of about 3 weight % to about 10 weight % with respect to the whole contents of the paste composition for printing. The total weight % of the dispersing agent, the conductive powders, the solvent, and the binder may be 100 weight %.

FIG. 2(*a*) is a schematic view showing the structure formula representing the block copolymer of the PPO-PEO-PPO according to the embodiment, and FIG. 2(*b*) is a schematic view showing the chain of the block copolymer of the PPO-PEO-PPO according to the embodiment. FIG. 3 is a view showing the dispersion of the dispersing agent adhering to the conductive powders in the paste composition for printing.

Referring to FIGS. 2 and 3, according to the paste composition for printing of the embodiment, the dispersing agent 20 is dissolved in the solvent so that the dispersing agent 20 adheres to the conductive powders 10, thereby improving the dispersibility of the conductive powders. Therefore, the dispersibility of the conductive powders 10 can be improved, so that the conductive powders 10 may adhere to the substrate S by the binder 30.

Therefore, according to the wiring electrode formed by using the paste composition for printing of the embodiment and the touch panel using the same, the use of an etching solution can be reduced through the alternative scheme of the conventional photolithography technology, so that the environment pollution can be reduced, the process steps can be reduced, and the source materials can be saved.

In addition, the particle dispersibility of the conductive powders is improved, so that the inking work of the paste composition can be facilitated, so that the micro-wiring electrodes can be more neatly patterned.

In addition, the reaction between the dispersing agent and the conductive powders is reduced, thereby preventing the metallic conductive powders from being oxidized.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A paste composition for printing comprising:

conductive powders;

a binder;

a dispersing agent; and a solvent;

wherein the dispersing agent includes a block copolymer of polyethylene oxide (PEO)-polypropylene oxide (PPO)-polyethylene oxide (PEO), or a block copolymer of polypropylene oxide (PPO)-polyethylene oxide (PEO)-polypropylene oxide (PPO);

wherein the conductive powders include silver (Ag) nano particles;

wherein the solvent includes a polyol, an ether, a glycol ether, or a glycol ether ester;

wherein the dispersing agent has a content of about 0.001 weight % to about 0.5 weight % with respect to a whole content of the paste composition for printing;

wherein the conductive powders have a content of about 50 weight % to about 90 weight % with respect to the whole content of the paste composition for printing;

wherein the solvent has a content of about 5 weight % to about 15 weight % with respect to the whole content of the paste composition for printing;

wherein the binder has a content of about 3 weight % to about 10 weight % with respect to the whole content of the paste composition for printing;

wherein the paste composition forms a wire electrode of a touch panel, wherein the nano particles are dispersed by the dispersing agent, wherein the wire electrode has a line width of 50 μm or less, and wherein the dispersing agent is dissolved in the solvent such that the dispersing agent adheres to the conductive powders.

2. The paste composition of claim 1, wherein the binder includes at least one of epoxy, ester, acryl, and vinyl.

3. The paste composition of claim 1, further comprising a curing agent.

* * * * *